US007328747B2

(12) United States Patent
Jones et al.

(10) Patent No.: US 7,328,747 B2
(45) Date of Patent: Feb. 12, 2008

(54) INTEGRATED BUOYANCY JOINT

(75) Inventors: Randy A. Jones, Park City, UT (US); Daniel C. Kennedy, II, Salt Lake City, UT (US)

(73) Assignee: EDO Corporation, Fiber Science Division, Salt Lake City, UT (US)

( * ) Notice: Subject to any disclaimer, the term of this patent is extended or adjusted under 35 U.S.C. 154(b) by 558 days.

(21) Appl. No.: 10/918,048

(22) Filed: Aug. 12, 2004

(65) Prior Publication Data

US 2005/0241832 A1 Nov. 3, 2005

Related U.S. Application Data

(60) Provisional application No. 60/568,478, filed on May 5, 2004, provisional application No. 60/568,101, filed on May 3, 2004.

(51) Int. Cl.
*E21B 29/12* (2006.01)

(52) U.S. Cl. ..... 166/367; 166/350; 405/224.4; 441/133

(58) Field of Classification Search ..... 166/350, 166/367, 355, 359, 338; 405/224.2–224.4; 441/133
See application file for complete search history.

(56) References Cited

U.S. PATENT DOCUMENTS

| | | | | |
|---|---|---|---|---|
| 3,470,838 | A | | 10/1969 | Daniell |
| 3,858,401 | A | | 1/1975 | Watkins |
| 3,933,108 | A | | 1/1976 | Baugh |
| 3,952,526 | A | | 4/1976 | Watkins et al. |
| 3,957,112 | A | | 5/1976 | Knibbe et al. |
| RE28,966 | E | | 9/1976 | Blockwick |
| 3,992,889 | A | | 11/1976 | Watkins et al. |
| 4,078,605 | A | | 3/1978 | Jones |
| 4,099,560 | A | | 7/1978 | Fischer et al. |
| 4,102,142 | A | | 7/1978 | Lee |
| 4,176,986 | A | * | 12/1979 | Taft et al. ..... 405/211 |
| 4,249,610 | A | | 2/1981 | Loland |
| 4,256,417 | A | | 3/1981 | Bohannon |
| 4,390,186 | A | | 6/1983 | McGee et al. |
| 4,398,487 | A | | 8/1983 | Ortloff et al. |
| 4,422,801 | A | | 12/1983 | Arlc et al. |
| 4,448,266 | A | | 5/1984 | Potts |
| 4,470,722 | A | | 9/1984 | Gregory |
| 4,474,129 | A | * | 10/1984 | Watkins et al. ..... 114/243 |
| 4,477,207 | A | | 10/1984 | Johnson |
| 4,511,287 | A | | 4/1985 | Horton |
| 4,596,531 | A | * | 6/1986 | Schawann et al. ..... 441/133 |
| 4,604,961 | A | | 8/1986 | Ortloff et al. |
| 4,606,673 | A | | 8/1986 | Daniell |
| 4,616,707 | A | | 10/1986 | Langner |
| 4,630,970 | A | | 12/1986 | Gunderson et al. |

(Continued)

FOREIGN PATENT DOCUMENTS

| | | | |
|---|---|---|---|
| GB | 2069450 | A | 8/1981 |

(Continued)

*Primary Examiner*—Thomas A Beach
(74) *Attorney, Agent, or Firm*—Thorpe North & Western

(57) ABSTRACT

A buoyancy system includes a plurality of buoyancy joints distributed along a riser system. Each joint can include a riser pipe, an external frame disposed around a riser and a vessel, and a buoyant cladding disposed between the vessel and the frame.

53 Claims, 3 Drawing Sheets

U.S. PATENT DOCUMENTS 4,634,314 A 1/1987 Pierce
4,646,840 A 3/1987 Bartholomew et al.
4,648,747 A 3/1987 Watkins et al.
4,652,022 A 3/1987 Nichols
4,702,321 A 10/1987 Horton
4,740,109 A 4/1988 Horton
4,768,455 A 9/1988 Maxson et al.
4,808,034 A 2/1989 Birch
4,821,804 A 4/1989 Pierce
4,934,871 A 6/1990 Kazokas, Jr.
5,044,828 A 9/1991 Berner, Jr. et al.
5,046,896 A * 9/1991 Cole ..... 405/195.1
5,098,132 A 3/1992 Burton
5,330,294 A 7/1994 Guesnon
5,368,648 A 11/1994 Sekizuka
5,421,413 A 6/1995 Allen et al.
5,431,511 A 7/1995 Guy
5,439,060 A 8/1995 Huete et al.
5,439,321 A 8/1995 Hunter
5,447,392 A 9/1995 Marshall
5,542,783 A 8/1996 Pollack
5,558,467 A 9/1996 Horton
5,651,709 A 7/1997 Nandakumar et al.
5,706,897 A 1/1998 Horton, III
5,758,990 A 6/1998 Davies et al.
5,771,975 A 6/1998 Anderson et al.
5,823,131 A 10/1998 Boatman et al.
5,873,416 A 2/1999 Horton, III
5,881,815 A 3/1999 Horton, III
5,984,584 A 11/1999 McMillan et al.
6,000,422 A 12/1999 Shigemoto
6,004,074 A 12/1999 Shanks, II
6,067,922 A 5/2000 Denison et al.
6,092,483 A 7/2000 Allen et al.
6,155,748 A 12/2000 Allen et al.
6,161,620 A 12/2000 Cox et al.
6,164,348 A 12/2000 Rodwell et al.
6,179,524 B1 1/2001 Allen et al.
6,193,441 B1 2/2001 Fisher
6,213,045 B1 4/2001 Gaber
6,227,137 B1 5/2001 Allen et al.
6,296,421 B2 * 10/2001 Fisher ..... 405/224.4
6,347,912 B1 2/2002 Thomas
6,367,846 B1 4/2002 Aaron, III
6,375,391 B1 4/2002 Børseth et al.
6,402,431 B1 6/2002 Nish
6,406,223 B1 6/2002 Thomas
6,435,775 B1 8/2002 Nish et al.
6,439,810 B1 8/2002 Nish et al.
6,488,447 B1 12/2002 Nish et al.
6,632,112 B2 10/2003 Nish et al.
6,848,863 B2 * 2/2005 Karayaka et al. ..... 405/211
6,854,516 B2 * 2/2005 Nish et al. ..... 166/350
6,896,062 B2 * 5/2005 Davies et al. ..... 166/350
7,008,141 B2 * 3/2006 Fitzgerald et al. ..... 405/224.2
7,097,387 B2 * 8/2006 Karayaka et al. ..... 405/211

FOREIGN PATENT DOCUMENTS

GB 2133446 A 7/1984
GB 2156407 A 10/1985

* cited by examiner

INTEGRATED BUOYANCY JOINT

Priority is claimed of U.S. Provisional Patent Application Nos. 60/568,101, filed May 3, 2004, and 60/568,478, filed May 5, 2004.

BACKGROUND OF THE INVENTION

1. Field of the Invention

The present invention relates generally to buoyancy for offshore oil production.

2. Related Art

As the cost of oil increases and/or the supply of readily accessible oil reserves are depleted, less productive or more distant oil reserves are targeted, and oil producers are pushed to greater extremes to extract oil from less productive oil reserves, or to reach more distant oil reserves. Such distant oil reserves may be located below the oceans, and oil producers have developed offshore drilling platforms in an effort to extend their reach to these oil reserves. In addition, some oil reserves are located farther offshore, and thousands of feet below the surface of the oceans.

For example, vast oil reservoirs have recently been discovered in very deep waters around the world, principally in the Gulf of Mexico, Brazil and West Africa. Water depths for these discoveries range from 1500 to nearly 10,000 ft. Conventional offshore oil production methods using a fixed truss type platform are not suitable for these water depths. These platforms become dynamically active (flexible) in these water depths. Stiffening them to avoid excessive and damaging dynamic responses to wave forces is prohibitively expensive.

Deep-water oil and gas production has thus turned to new technologies based on floating production systems. These systems come in several forms, but all of them rely on buoyancy for support and some form of a mooring system for lateral restraint against the environmental forces of wind, waves and current.

These floating production systems (FPS) sometimes are used for drilling as well as production. They are also sometimes used for storing oil for offloading to a tanker. This is most common in Brazil and West Africa, but not in Gulf of Mexico as of yet. In the Gulf of Mexico, oil and gas are exported through pipelines to shore.

Certain floating oil platforms, i.e., Spars or Deep Draft Caisson Vessels (DDCV), and large "Semi-submersibles" have been developed to reach these deep-water oil reserves. Most of these floating platforms are designed to maximize the platform's ability to produce and process crude oil (thus maximizing revenue), while at the same time minimize the overall size and mass of the platform hull and thus minimize the required capital investment. For this reason, it is advantageous to utilize the available hull buoyancy for topside processing equipment, and to minimize or even decouple other "parasitic" weight that would otherwise increase capital costs or reduce revenue-generating payload.

Steel tubes or pipes, known as risers, are suspended from these floating platforms, and extend the thousands of feet to reach the ocean floor, and the oil reserves beyond.

Typical risers are either vertical (or nearly vertical) pipes held up at the surface by tensioning devices (called Top Tensioned riser); or flexible pipes which are supported at the top and formed in a modified catenary shape to the sea bed; or steel pipe which is also supported at the top and configured in a catenary to the sea bed (Steel Catenary Risers—commonly known as SCRs).

The flexible and SCR type risers may in most cases be directly attached to the floating vessel. Their catenary shapes allow them to comply with the motions of the FPS caused by environmental forces. These motions can be as much as 10-20% of the water depth horizontally, and 10s of feet vertically, depending on the type of vessel, mooring and location.

Top Tensioned Risers (TTRs) typically need to have higher tensions than the flexible risers, and the vertical motions of the vessel need to be isolated from the risers. TTRs have significant advantages for production over the other forms of risers, however, because they allow the wells to be drilled directly from the FPS, avoiding an expensive separate floating drilling rig. Also, wellhead control valves placed on board the FPS allow for the wells to be maintained from the FPS. Flexible and SCR type production risers require the wellhead control valves to be placed on the seabed where access is difficult and maintenance is expensive. These surface wellhead and subsurface wellhead systems are commonly referred to as "Dry Tree" and "Wet Tree" types of production systems, respectively. Drilling risers must be of the TTR type to allow for drill pipe rotation within the riser. Export risers may be of either type.

TTR tensioning systems are a technical challenge, especially in very deep water where the required top tensions can be 1,000,000 lbs (1,000 kips) or more. Some types of FPS vessels, e.g. ship shaped hulls, have extreme motions which are too large for TTRs. These types of vessels are only suitable for flexible risers, or other free-standing systems. Other, low heave (vertical motion), FPS designs are suitable for TTRs. This includes Tension Leg Platforms (TLP), Semi-submersibles and Spars, all of which are in service today.

One type of riser tensioning system that may be employed calls for buoyancy that is distributed along the vertical length of the riser. Depending on the total weight of each riser (which determines how much net buoyancy is desired) and other requirements, it may be more advantageous to attach buoyant elements along the entire length of the riser system, rather than to concentrate all the buoyancy near the system's upper end.

Of the aforementioned floating production systems, only the TLP and Spar platforms use TTR production risers. Semi-submersibles may use TTRs for drilling risers, but these must be disconnected in extreme weather. Production risers need to be designed to remain connected to the seabed in extreme events, typically the 100 year return period storm. Only very stable vessels, such as TLPs and Spars are suitable for this.

Early TTR designs employed on semi-submersibles and TLPs used active hydraulic tensioners to support the risers by keeping the tension relatively constant during wave motions. As tensions and stroke requirements grow, these active tensioners become prohibitively expensive. They also require large deck area, and the buoyancy loads have to be carried by the FPS structure.

Spar type platforms recently used in the Gulf of Mexico use a passive means for tensioning the risers. These type platforms have a very deep draft with a central shaft, or centerwell, through which the risers pass. Types of spars include the Caisson Spar (cylindrical), the "Truss" spar and "Cell" spar. There may be as many as 40 production risers passing through a single centerwell. Even the most recent designs for large buoyancy cans used on Spars are limited in diameter and overall length, and may not be feasible or cost-effective where the net buoyancy requirement is in the range of 3000-4000 kips. This may be driven by the need to employ very heavy wall, or double wall riser pipe systems. In cases such as this, it may be more cost-effective to utilize a system of distributed buoyancy elements, rather than conventional air cans used on TTRs.

The underlying principal of both TTR buoyancy cans and distributed buoyancy systems is to remove a load-bearing connection between the floating vessel and the risers. Whether located at the top of the riser system (near the water surface) or distributed along the riser's total length, the buoyant elements need to provide enough buoyancy to support the required tension in the risers, the weight of the buoyant elements, and the weight of the surface wellhead. One disadvantage with TTR air cans is that they are normally formed of metal, and thus add considerable weight themselves. Thus, the metal air cans must support the weight of the risers and themselves. In addition, the air cans are often built to pressure vessel specifications, and are thus costly and time consuming to manufacture.

Conventional designs for distributed buoyancy systems are based on foam-filled, half-round sections that are mechanically attached (bolted) around a riser pipe. Storage and staging of these buoyancy sections can be a cumbersome task on an offshore platform, where open deck space is all but nonexistent. Installation is likewise time-consuming and requires heavy tools.

As risers have become longer by going deeper, their weight has increased substantially. One solution to this problem has been to simply increase the number of buoyant sections added to each riser string, since the maximum diameter of said buoyant shells is normally limited to that which will pass through the rotary table while the riser joints are being "run," or assembled and lowered into the water.

One problem with typical buoyancy systems is that if they are top tensioned, and the buoyancy force is concentrated at the top of the riser, it may result in higher stress, strain and/or force concentrations. Another problem with buoyancy is water pressure, especially at greater depths, that can crush conventional buoyancy cans or the like. While some buoyancy systems resolve that problem by utilizing expensive, crush-resistant foams, the foams themselves are usually very dense and can be very expensive. Yet another problem with providing buoyancy is transportation of the buoyancy system to the drill site, or the offshore platform. A related problem is the expense and difficulty of installing and/or assembling the buoyancy system. Many systems can be labor intensive and inefficient to install.

SUMMARY OF THE INVENTION

It has been recognized that it would be advantageous to develop an improved buoyancy system for offshore oil platforms. It has been recognized that it would be advantageous to develop a buoyancy system that is inexpensive and easy to manufacture, transport, and install. It has been recognized that it would be advantageous to develop a buoyancy system that can be distributed along the length of the riser, while resisting crushing by water pressure.

The invention provides a buoyancy joint configured to provide buoyancy for a riser system of an offshore platform. The buoyancy joint includes a vessel coupled to a riser section and pressurized with gas. An external frame is disposed around the vessel, and an enclosure substantially encloses the vessel and defines a space between the enclosure and the vessel. A buoyant cladding is disposed in the space between the vessel and the enclosure.

In accordance with one aspect of the present invention, the enclosure can include a plurality of flat panels forming a rectilinear box.

In accordance with another aspect of the present invention, a plurality of buoyancy joints can have a transportation configuration and an operational configuration. In the transportation configuration, the plurality of buoyancy joints is bundled together. In the operational configuration, the plurality of buoyancy joints is coupled along a riser system.

The invention provides a method for transporting and installing buoyancy for a riser of an offshore platform. The method includes providing a plurality of buoyancy joints, each buoyancy joint having an external frame with a lateral perimeter having at least three linear sides. The plurality of buoyancy joints is bundled together in a bundled configuration with the buoyancy joints laterally adjacent one another and the linear sides of adjacent buoyancy joints abutting one another. The plurality of buoyancy joints is transported in the bundled configuration from a manufacturing site to a field site. The plurality of buoyancy joints is disposed along a riser system extending submerged between the offshore platform and a wellhead with riser sections of the buoyancy joints operatively coupled in series and in fluid communication with riser sections of the riser system.

The invention provides a method for fabricating a buoyancy joint for a riser of an offshore platform. The method includes providing a vessel with opposite apertures at opposite longitudinal ends capable of receiving a riser section therethrough, and an enclosure formed substantially around the vessel. Foam is injected into the enclosure to substantially fill space between the vessel and the enclosure.

Additional features and advantages of the invention will be apparent from the detailed description which follows, taken in conjunction with the accompanying drawings, which together illustrate, by way of example, features of the invention.

DETAILED DESCRIPTION

Figure 1:
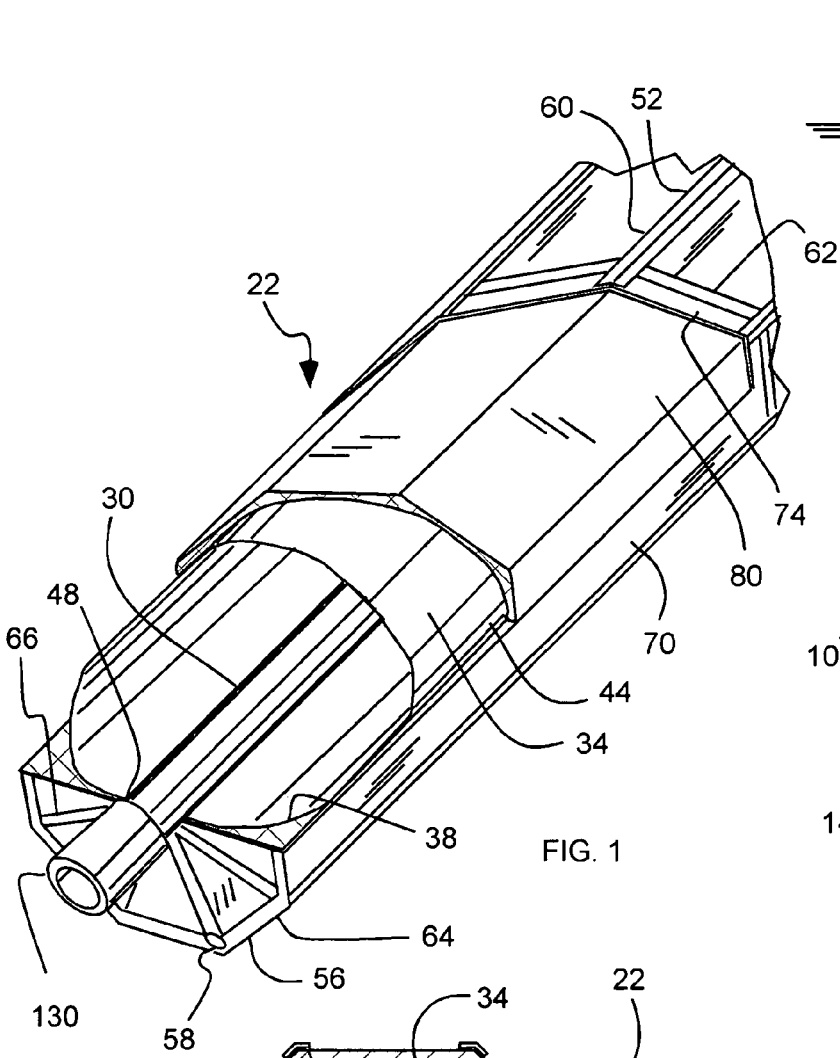
FIG. 1 is a partial perspective view of an integrated buoyancy joint (IBJ) of a buoyancy system in accordance with an embodiment of the present invention.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

Figure 2:
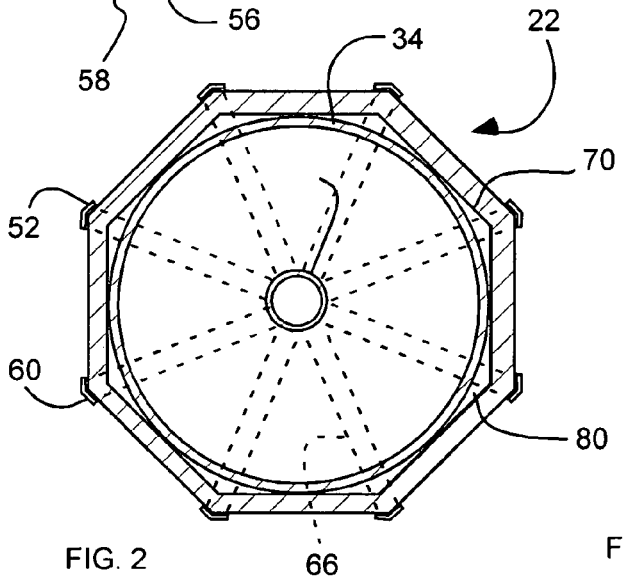
FIG. 2 is a cross-sectional end view of the integrated buoyancy joint of FIG. 1.
Figure 3:
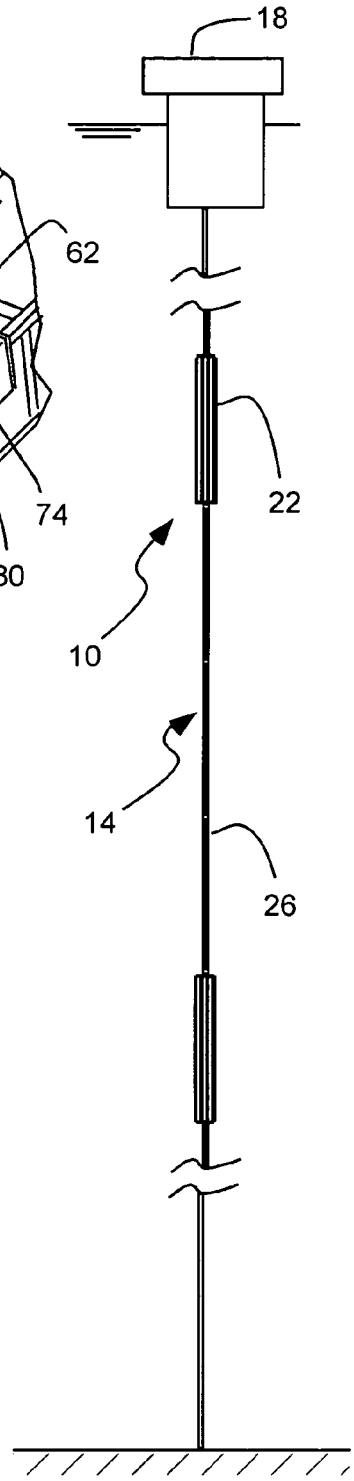
FIG. 3 is a schematic side view of an offshore platform with a riser system and a buoyancy system including a plurality of integrated buoyancy joints of FIG. 1.

As illustrated in FIGS. 1-7, a buoyancy system, indicated generally at 10, in accordance with the present invention is shown for providing buoyancy to a riser system 14 extending from an offshore oil platform 18 to wellheads or control modules on the ocean floor. The system 10 can include a plurality of integrated buoyancy joints (IBJ) 22 that can be coupled in series with a plurality of riser sections 26 along the length of the riser system in an operational configuration, as shown in FIG. 3. Buoyancy elements are permanently affixed to individual riser sections, or "joints," forming integrated modules that are then distributed periodically along the length of the riser system 14. The riser system 14 can include a plurality of individual, discrete riser sections 26 coupled together in series to form a continuous riser system. The riser sections 26 can include elongated pipes with hollows therein to convey oil, gas or the like from the wellhead to the oil platform.

Deep water oil drilling and production is one example of a field that may benefit from use of such a buoyancy system 10. The term "deep water, floating oil platform" is used broadly herein to refer to buoyant platforms located above and below the surface, such as are utilized in drilling and/or production of fuels, such as oil and gas, typically located off-shore in the ocean at locations corresponding to depths of over several hundred or thousand feet, including classic, truss, and concrete spar-type platforms or Deep Draft Caisson Vessels, etc. Thus, the fuel, oil or gas reserves are located below the ocean floor at depths of over several hundred or thousand feet of water.

A truss-type, floating platform 18 is shown schematically in FIG. 3, and has above-water, or topside, structure, and below-water, or submerged, structure. The above-water structure includes several decks or levels which support operations such as drilling, production, etc., and thus may include associated equipment, such as a work over or drilling rig, production equipment, personnel support, etc. The submerged structure may include a hull, which may be a full cylinder form. The hull may include bulkheads, decks or levels, fixed and variable seawater ballasts, tanks, etc. The fuel, oil or gas may be stored in tanks in the hull. The platform, or hull, also has mooring fairleads to which mooring lines, such as chains or wires, are coupled to secure the platform or hull to an anchor in the sea floor.

The hull also may include a truss or structure. The hull and/or truss may extend several hundred feet below the surface of the water, such as 600 feet deep. A centerwell or moonpool is located in the hull or truss structure. One or more riser systems or lengths of riser pipe extend through the hull, truss, and/or centerwell. The centerwell is typically flooded and contains compartments or sections for separating the risers. The hull provides buoyancy for the platform 18 while the centerwell protects the risers.

It is of course understood that the truss-type, floating platform 18 depicted in FIG. 3 is merely exemplary of the types of floating platforms that may be utilized. For example, other spar-type platforms may be used, such as classic spars, or concrete spars.

The risers or riser systems 14 are typically steel pipes or tubes with a hollow interior for conveying the fuel, oil or gas from the reservoir, to the floating platform 18. The pipes or tubes extend between the reservoir and the floating platform 18, and include production risers, drilling risers, and export/import risers. The riser system may extend to a surface platform or a submerged platform. The riser systems 14 can be coupled to the platform 18 by a thrust plate located on the platform 18 such that the riser systems 14 are suspended from the thrust plate. The buoyancy system 10 can support deep water risers or deep water riser systems. The term "deep water risers" or "deep water riser system" is used broadly herein to refer to pipes or tubes extending over several hundred or thousand feet between the reservoir and the floating platform 18, including production risers, drilling risers, and export/import risers.

In one aspect, the buoyancy system 10 is utilized to access deep-water oil and gas reserves with deep-water riser systems 14 which extend to extreme depths, such as over 1000 feet, over 3000 feet in another aspect, and over 5000 feet in yet another aspect. It will be appreciated that thousand feet lengths of steel pipe are exceptionally heavy, or have substantial weight. It also will be appreciated that steel pipe is thick or dense (i.e. approximately 0.283 $lbs/in^3$), and thus experiences relatively little change in weight when submerged in water, or seawater (i.e. approximately 0.037 $lbs/in^3$). Thus, for example, steel only experiences approximately a 13% decrease in weight when submerged. Therefore, thousands of feet of riser, or steel pipe, is essentially as heavy, even when submerged.

The buoyancy system 10 can be coupled to or along the riser systems 14 to support or provide buoyancy to the riser systems. The buoyancy system 10 includes one or more integrated buoyancy joints (IBJs) 22 which are submerged and filled with a buoyant material, such as air, to produce a buoyancy force to buoy or support the riser systems 14.

As stated above, the thousands of feet of risers exert a substantial downward force on the buoyancy system 10. It will be appreciated that the deeper the targeted reservoir, or as drilling and/or production moves from hundreds of feet to several thousands of feet, the risers will become exceedingly more heavy, and more and more buoyancy force will be required to support the riser systems. In addition, it will be appreciated that deeper depths exert extremely high pressures. Furthermore, it will be appreciated that deeper depths are often found further from shore, or from manufacturing sites, making transportation of equipment an issue. It has been recognized that it would be advantageous to improve the systems and processes for accessing deep reserves, improve the manufacture and transportation of buoyancy for riser systems to reduce the weight of the risers and platforms, and increase the buoyant force.

Referring to FIGS. 1 and 2, each integrated buoyancy joint 22 can include an elongated riser section 30. The riser section 30 can be a 12" steel production riser pipe with a length of approximately 20-60 feet. As described above, the riser section 30 of the buoyancy joint 22 can be coupled in series with riser section 26 of the riser system 14 to form a continuous hollow tube for transporting fuel, oil, gas or the like.

A vessel 34 is coupled to and laterally surrounds the riser section 30. The vessel 34 can include a pair of hemispherical domes 38 separated by, and joint to, an intermediate section or tube 44. Each dome 38 can have an aperture through which the riser section 30 extends. Thus, the riser section 30 can extend through a center of the vessel 34, the domes 38 and the intermediate section or tube 44, and can define a longitudinal axis of the buoyancy joint 22. The domes 38 can be sealed around the riser section 30, and to the intermediate section or tube 44, to form the vessel 34, and an enclosure with or around the riser section. A seal 48 can be disposed between the domes 38 and the riser section 30. The vessel 34 can be filled with a buoyant material, such as air, or another gas, such as nitrogen. In addition, the vessel 34 can be pressurized to resist pressure forces at great depths. The domes and intermediate section or tube can be formed of fiber reinforced plastic, and can be overwrapped with fiber or other structural material. Thus, the vessel 34 can be lightweight to reduce the weight of the riser system 14, and strong to resist internal and external pressures. Alternatively, the domes and intermediate section can be formed of metal, such as steel. The vessel, or the domes and the intermediate section, can have a diameter of approximately 60 inches.

An external frame 52 can surround the vessel 34, and can laterally surround the riser section 30. The frame 52 can form a rigid, external skeleton or framework, and can include a plurality of interconnected frame members. The frame 52 or frame members can be formed of metal, such as angle iron or tubes, welded together. The frame 52 can include a pair of opposite end caps 56. The end caps 56 can form a lateral perimeter or outermost circumference of the buoyancy joint 22. The end caps 56 can be shaped, or can have a cross-sectional shape with respect to the longitudinal axis, with at least three straight or linear sides. Thus, the shape of the end caps 56 can be triangular, rectangular, square, pentagonal, hexagonal, octagonal, etc. The straight or linear portions of the perimeter or circumference of the frame facilitate stacking, storage and transportation of the buoyancy joints 22, as discussed in greater detail below.

The end caps 56 can include apertures 58, eyes, or similar devices to facilitate lifting, such as being engaged by hooks. The frame 52 can also include longitudinal members 60 interconnecting the end caps 56, and lateral members 62 interconnecting the longitudinal members 60. The longitudinal members can extend along the edges of the buoyancy joints. The end caps 56 can include perimeter members 64 and radial members 66 extending between the riser section 30 and the perimeter members 64.

The external frame 52 or members thereof can be formed of metal, such as steel, welded or bolted together. For example, angle iron can be used to fabricate the frame. Alternatively, non-metallic or hybrid material can be used.

An enclosure 70 is associated with the external frame 52, and substantially encloses the vessel 34. A space is defined between the enclosure 70 and the vessel 34. The frame 52 can extend around the enclosure 70, such as at the edges. The enclosure 70 can include a plurality of flat panels 74 forming a rectilinear box. The flat panels 74 can be formed by fiber reinforced plastic. Again, the fiber reinforced plastic can reduce weight of the buoyancy system 10 or riser system 14. Alternatively, the flat panels can be formed of metal, such as steel. The enclosure 70 or flat panels 74 can be carried by, or supported by, the frame 52. Alternatively, the enclosure or flat panels can extend around an exterior of the frame.

A buoyant cladding 80 is disposed in the space between the vessel 34 and the external frame 52. The cladding 80 can be buoyant to provide additional buoyancy, and can be rigid to provide structural rigidity to resist pressure forces. For example, the cladding 80 can be formed of, or can include foam or syntactic foam.

The vessel 34 can have an outer diameter that substantially equals an inner diameter of the enclosure 70, as shown in FIG. 2, so that the vessel maximizes a volume defined by the enclosure 70, and minimizes the space between the vessel and the enclosure. The vessel 34 can occupy a majority of the space within the frame or enclosure, thus reducing the amount of syntactic foam used. The vessel can be pressurized with inexpensive buoyant material, such as air or nitrogen. The pressurized vessel and syntactic foam cladding provide crush resistance at great depths. Thus, the buoyancy joint can maximize use of less expensive buoyancy, such as compressed air or nitrogen, while minimizing the use of more expensive buoyancy, such as syntactic foam. The cladding 80 can be formed in any number of sections, disposed around the vessel. In addition, the cladding can have an internal cavity with a circular cross-section and a hemispherical shape to match the domes and intermediate section of the vessel. The cladding can have an outer rectilinear shape to match the rectilinear shape of the frame or enclosure. Therefore, the space within the buoyancy joint is efficiently used for buoyancy.

Figure 4:
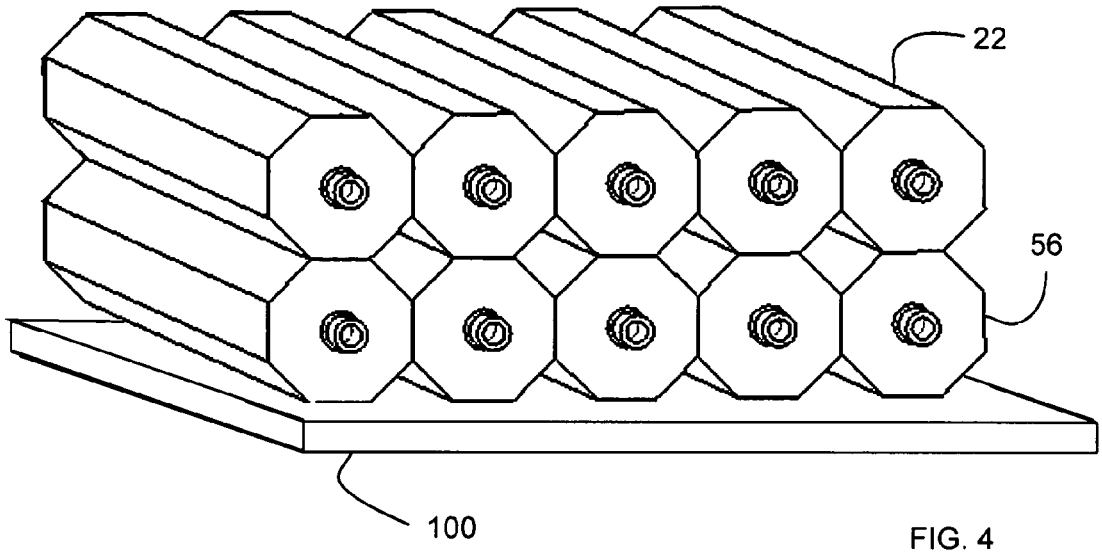
FIG. 4 is a perspective view of a plurality of integrated buoyancy joints of a buoyancy system of FIG. 1 shown in a horizontal transportation configuration.
Figure 5:
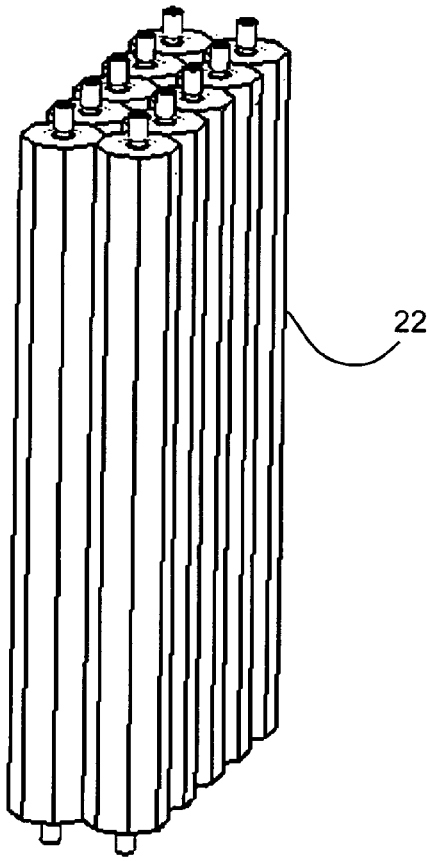
FIG. 5 is a perspective view of a plurality of integrated buoyancy joints of a buoyancy system of FIG. 1 shown in a vertical transportation configuration.

The buoyancy system 10 or plurality of integrated buoyancy joints 22 can have an operational configuration, as shown in FIG. 3, and a transportation configuration, as shown in FIG. 4 or 5. In the operation configuration, the plurality of buoyancy joints 22 are coupled along the length of the riser system 14, and can form a continuous conduit with the other riser sections. In the transportation configuration, the buoyancy joints 22 can be stacked and/or bundled together. The buoyancy joints 22 can be oriented horizontally during transportation, as shown in FIG. 4, such as on a barge or deck boat 100. Alternatively, the buoyancy joints 22 can be oriented vertically during transportation, as shown in FIG. 5. Thus, the buoyancy joints 22 can be safely and conveniently transported to the oil platform for use. As described above, the end caps 56, or sides thereof, can abut to and stack with the end caps of adjacent buoyancy joints. The straight or rectilinear sides of the buoyancy joints facilitate stacking and transportation.

Figure 6:
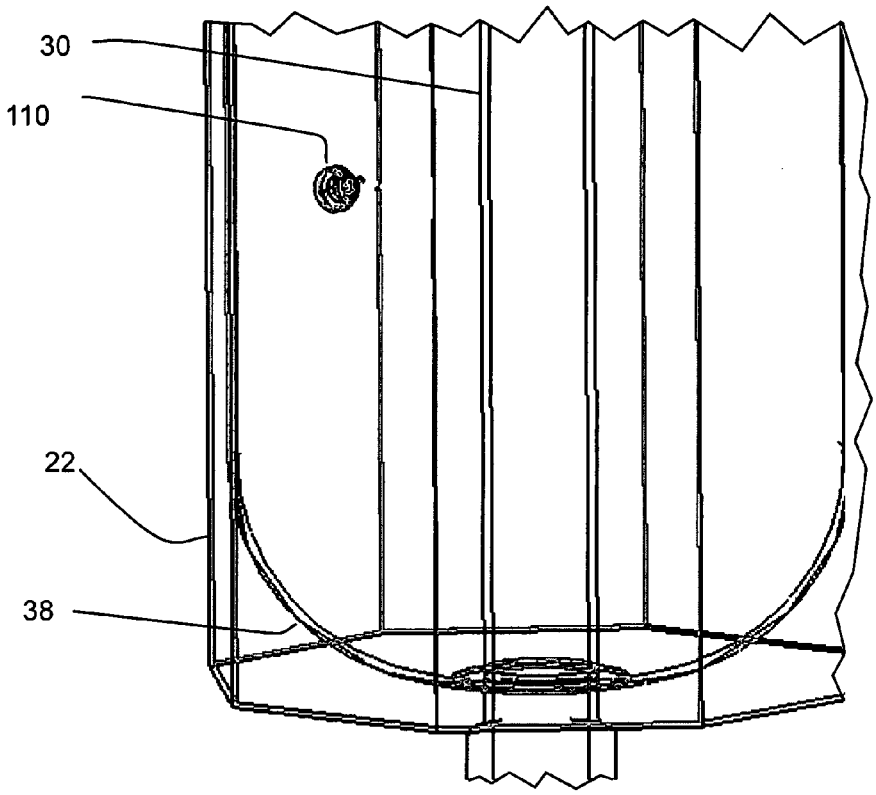
FIG. 6 is a partial side view of the integrated buoyancy joint of FIG. 1.
Figure 7:
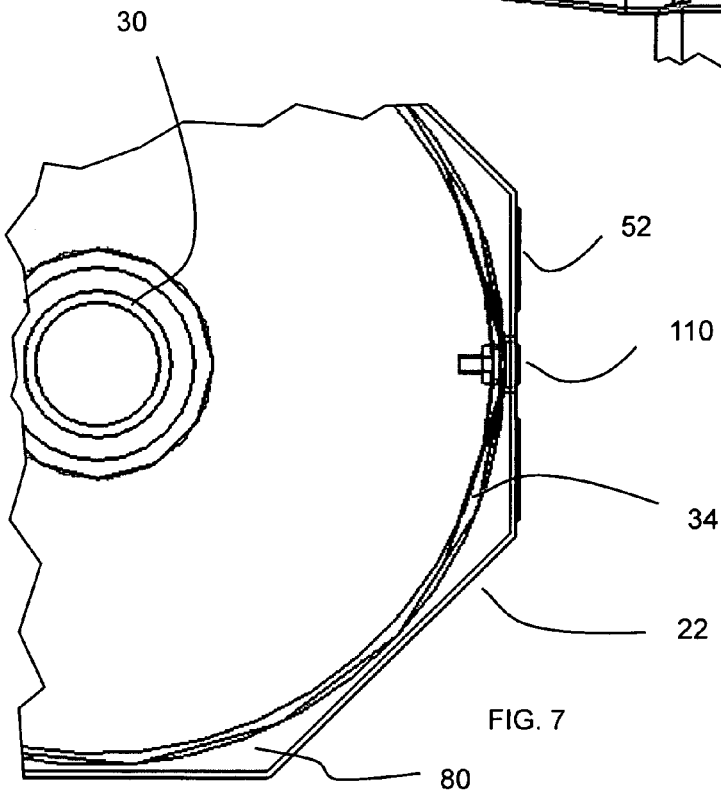
FIG. 7 is a partial end view of the integrated buoyancy joint of FIG. 1.

Referring to FIGS. 6 and 7, a pressurization tube 110 or pressure port can extend to the vessel 34 to allow a pressurized gas to be introduced into the vessel. The pressurization tube 110 or pressure port can be positioned on a side of the buoyancy joint 22, and can extend through the enclosure 70 or panels 74, through the cladding 80, and through the vessel 34. Alternatively, the pressurization tube 110 or pressure port can extend through the seal between the dome and the riser. The pressurization tube or pressure port is an example of one means for pressurizing the vessel. The pressurization tube or pressure port can be accessible by a submersible ROV (remotely operated vehicle) so that the vessel can be pressurized while under water, even at great depth.

As indicated above, in operation, the buoyancy joints 22 can be spaced-apart or distributed along the length of the riser system 14. Thus, the buoyancy system can provide a distributed buoyancy force along the length of the riser. The buoyancy joints can be separated by riser sections 26. For example, the buoyancy system, or modules thereof, can be configured to provide thousands of kips net buoyancy along a 10,000 foot riser. The buoyancy system can provide the primary buoyancy for the riser, or an auxiliary (supplemental) buoyancy. Thus, the individual buoyancy joints are sized to produce at least 50 kips net buoyancy. The vessels and shrouds of each module can be sized and shaped to provide a desired buoyancy force at a designated depth. Thus, the vessels can have different lengths and/or diameters with respect to one another.

The modules or frames can include trim tabs, boards, or helical strakes to offset vortex-induced vibration (VIV), and reduce drag due to moving current in the water. Module frames that are triangular in cross-section may also improve VIV or reduce drag from underwater currents.

The IBJ modules can be fabricated on shore, stacked, and shipped to the floating oil platform, where they can be installed. The rectilinear frames facilitates stacking and transportation. The vessels can be pressurized (as dictated by service depth) during installation, or after.

The riser section 30 of the buoyancy joint can be provided "bare," or can be a continuous tube or pipe. Alternatively, the riser section 30 can be provided with a standard or custom coupling 130 (top and/or bottom). The coupling 130 can be an enlarged pipe to receive the ends of the riser section 30 therein, and secured by welding.

The external frame and/or integrated buoyancy joint can be shaped to facilitate transportation, stacking and storage. For example, the frame can have a rectilinear shape. In addition, the frame or integrated buoyancy joint can have a shape to efficiently utilize space or maximize buoyancy within given restraints. It will be appreciated that the integrated buoyancy joints may be disposed in, or may pass through, centerwells or rotary tables with cross-sectional openings therein. Thus, the shape of the integrated buoyancy joint or frames can maximize the buoyancy while still passing through the openings.

A method for transporting and installing buoyancy for a riser system 14 of an offshore platform 18 includes providing a plurality of buoyancy joints 22 as described above, each having an external frame 52 with a lateral perimeter having at least three linear sides. The plurality of buoyancy joints are bundled together in a bundled configuration, as shown in FIGS. 4 and 5, with the buoyancy joints laterally adjacent one another and the linear sides of adjacent buoyancy joints abutting one another. The plurality of buoyancy joints are transported in the bundled configuration from a manufacturing site to a field site. The plurality of buoyancy joints are disposed along the riser system 14 extending submerged between the offshore platform and a wellhead. The riser sections of the buoyancy joints are operatively coupled in series and in fluid communication with riser sections of the riser system.

As shown in FIG. 4, the plurality of buoyancy joints 22 can be disposed in a stacked configuration with each buoyancy joint in a horizontal orientation. In addition, the plurality of buoyancy joints in the bundled configuration on a deck of a barge or a deck boat, as shown.

The buoyancy joints can be lifted and manipulated by engaging lift-eyes 58 in the external frames of the buoyancy joints with hooks. For example, the buoyancy joints can be lifted onto the platform, and positioned for coupling along the riser system.

A method for fabricating a buoyancy joint for a riser of an offshore platform described above can include providing a vessel with opposite apertures at opposite longitudinal ends and capable of receiving a riser section therethrough, and an enclosure formed substantially around the vessel. Foam can be injected into the enclosure to substantially fill space between the vessel and the enclosure, and form the buoyancy cladding.

It is to be understood that the above-referenced arrangements are only illustrative of the application for the principles of the present invention. Numerous modifications and alternative arrangements can be devised without departing from the spirit and scope of the present invention. While the present invention has been shown in the drawings and fully described above with particularity and detail in connection with what is presently deemed to be the most practical and preferred embodiment(s) of the invention, it will be apparent to those of ordinary skill in the art that numerous modifications can be made without departing from the principles and concepts of the invention as set forth herein.

What is claimed is:

1. A buoyancy joint configured to provide buoyancy for a riser system of an offshore platform, the buoyancy joint comprising:

a) a riser section;

b) a vessel, directly coupled to the riser section, configured to be pressurized with gas;

c) an external frame, disposed around the vessel;

d) an enclosure, associated with the external frame and substantially enclosing the vessel, defining a space between the enclosure and the vessel; and e) a buoyant cladding, disposed in the space between the vessel and the enclosure.

2. A buoyancy joint in accordance with claim 1, wherein the enclosure includes a plurality of flat panels forming a rectilinear box.

3. A buoyancy joint in accordance with claim 2, wherein the flat panels include fiber reinforced plastic.

4. A buoyancy joint in accordance with claim 1, further comprising a plurality of buoyancy joints spaced-apart from one another and separated by other riser sections coupled between the buoyancy joints.

5. A buoyancy joint in accordance with claim 4, wherein the plurality of buoyancy joints has:

a transportation configuration in which the plurality of buoyancy joints are bundled together; and an operational configuration in which the plurality of buoyancy joints are coupled along a riser system.

6. A buoyancy joint in accordance with claim 5, wherein the plurality of buoyancy joints are oriented horizontally in the transportation configuration.

7. A buoyancy joint in accordance with claim 5, wherein the plurality of buoyancy joints include end caps that have at least three linear sides that abut laterally to adjacent end caps of adjacent buoyancy joints in the transportation configuration.

8. A buoyancy joint in accordance with claim 4, wherein each of the plurality of buoyancy joints has a vessel with a diameter or length that is different from respective diameters or lengths of vessels of other buoyancy joints associated with the riser system.

9. A buoyancy joint in accordance with claim 1, wherein the enclosure forms a mold configured to receive an uncured foam material therein to form the buoyant cladding.

10. A buoyancy joint in accordance with claim 1, wherein:

the vessel includes a fiber reinforced plastic;

the buoyant cladding includes rigid foam; and the enclosure includes a fiber reinforced plastic.

11. A buoyancy joint in accordance with claim 1, wherein the buoyant cladding includes rigid foam substantially filling the space between the vessel and the enclosure.

12. A buoyancy joint in accordance with claim 1, wherein the vessel fills a majority of a volume defined by the external frame, and the cladding fills a minority of the volume with respect to the vessel.

13. A buoyancy joint in accordance with claim 1, wherein the vessel has an outer diameter that substantially equals an inner diameter of the enclosure.

14. A buoyancy joint in accordance with claim 1, wherein the external frame has a cross-sectional shape with respect to a longitudinal axis with at least three linear sides.

15. A buoyancy joint in accordance with claim 14, wherein the cross-sectional shape is selected from the group consisting of: square, rectangular, triangular, pentagonal, hexagonal, and octagonal.

16. A buoyancy joint in accordance with claim 14, wherein the vessel has a substantially circular cross-sectional shape with respect to the longitudinal axis.

17. A buoyancy joint in accordance with claim 1, wherein the vessel includes opposite, spaced-apart, hemispherical domes, each having an aperture through which the riser section extends, and seals formed between the riser section and the domes.

18. A buoyancy joint in accordance with claim 1, wherein the external frame includes:

a pair of spaced apart end caps having an outer perimeter orthogonal to a longitudinal axis shaped with at least three linear sides;

longitudinal members, extending between the end caps;

lateral members, extending between the riser section and the outer perimeter; and a plurality of lift-eyes, attached to the frame, configured to allow for engaging and lifting the buoyancy joint.

19. A buoyancy joint in accordance with claim 1, wherein the external frame includes:

means for intercoupling the external frame with other external frames of other buoyancy joints bundled together.

20. A buoyancy joint in accordance with claim 1, further comprising means for joining the riser section to other riser sections.

21. A buoyancy joint in accordance with claim 1, further comprising a pressurization tube extending into the vessel for pressuring the vessel.

22. A buoyancy joint configured to provide buoyancy for a riser system of an offshore platform, the buoyancy joint comprising:

a) a riser section including an elongated pipe with a hollow therein configured to transport oil or gas;

b) a vessel, directly coupled to and laterally surrounding the riser section, configured to be pressurized with gas;

c) an external frame, disposed around the vessel;

d) an enclosure, associated with the external frame and substantially enclosing the vessel, defining a space between the enclosure and the vessel;

e) the enclosure including a plurality of flat panels;

f) the external frame and the enclosure each having a cross-sectional shape with respect to a longitudinal axis with at least three linear sides; and g) a buoyant cladding, disposed in the space between the vessel and the enclosure.

23. A buoyancy joint in accordance with claim 22, further comprising a plurality of buoyancy joints spaced-apart from one another and separated by other riser sections coupled between the buoyancy joints.

24. A buoyancy joint in accordance with claim 23, wherein each of the plurality of buoyancy joints has a vessel with a diameter or length that is different from respective diameters or lengths of vessels of other buoyancy joints associated with the riser system.

25. A buoyancy joint in accordance with claim 23, wherein the plurality of buoyancy joints has:

a transportation configuration in which the plurality of buoyancy joints are bundled together; and an operational configuration in which the plurality of buoyancy joints are coupled along a riser system.

26. A buoyancy joint in accordance with claim 25, wherein the plurality of buoyancy joints are oriented horizontally in the transportation configuration.

27. A buoyancy joint in accordance with claim 25, wherein the plurality of buoyancy joints include end caps that have at least three linear sides that abut laterally to adjacent end caps of adjacent buoyancy joints in the transportation configuration.

28. A buoyancy joint in accordance with claim 22, wherein the enclosure forms a mold configured to receive an uncured foam material therein to form the buoyant cladding.

29. A buoyancy joint in accordance with claim 22, wherein:

the vessel includes a fiber reinforced plastic;

the buoyant cladding includes rigid foam; and the enclosure includes a fiber reinforced plastic.

30. A buoyancy joint in accordance with claim 22, wherein the buoyant cladding includes rigid foam substantially filling the space between the vessel and the enclosure.

31. A buoyancy joint in accordance with claim 22, wherein the vessel fills a majority of a volume defined by the external frame, and the cladding fills a minority of the volume with respect to the vessel.

32. A buoyancy joint in accordance with claim 22, wherein the vessel has an outer diameter that substantially equals an inner diameter of the enclosure.

33. A buoyancy joint in accordance with claim 22, wherein the cross-sectional shape is selected from the group consisting of: square, rectangular, triangular, pentagonal, hexagonal, and octagonal.

34. A buoyancy joint in accordance with claim 22, wherein the vessel has a substantially circular cross-sectional shape with respect to the longitudinal axis.

35. A buoyancy joint in accordance with claim 22, wherein the vessel includes opposite, spaced-apart, hemispherical domes, each having an aperture through which the riser section extends, and seals formed between the riser section and the domes.

36. A buoyancy joint in accordance with claim 22, wherein the external frame includes:

a pair of spaced apart end caps having an outer perimeter orthogonal to a longitudinal axis shaped with at least three linear sides;

longitudinal members, extending between the end caps;

lateral members, extending between the riser section and the outer perimeter; and a plurality of lift-eyes, attached to the frame, configured to allow for engaging and lifting the buoyancy joint.

37. A buoyancy joint in accordance with claim 22, wherein the external frame includes:

means for intercoupling the external frame with other external frames of other buoyancy joints bundled together.

38. A buoyancy joint in accordance with claim 22, further comprising means for joining the riser section to other riser sections.

39. A buoyancy joint in accordance with claim 22, further comprising a pressurization tube extending into the vessel for pressuring the vessel.

40. A buoyancy system, comprising:

a) an elongated riser system with a plurality of interconnected riser sections configured to be submerged and to extend between a floating platform and a wellhead;

b) a plurality of buoyancy joints, operatively coupled in series with the riser sections of the riser system, each buoyancy joint including:

i) a riser section;

ii) a vessel, surrounding the riser section, configured to be pressurized, and including:

a pair of opposite hemispherical domes, disposed at opposite ends of the vessel and each having an aperture through with the riser section extends; and a seal, disposed between the domes and the riser;

iii) an external frame, surrounding the vessel, having a cross-sectional shape with respect to a longitudinal axis with at least three linear sides;

iv) an enclosure associated with the external frame and substantially enclosing the vessel, defining a space between the enclosure and the vessel; and v) a buoyant cladding, disposed in the space between the vessel and the enclosure; and c) the plurality of buoyancy joints having:

i) a transportation configuration in which the plurality of buoyancy joints are bundled together; and ii) an operational configuration in which the plurality of buoyancy joints are coupled along a riser system.

41. A buoyancy system in accordance with claim 40, wherein the buoyant cladding includes rigid foam substantially filling the space between the vessel and the enclosure.

42. A buoyancy system in accordance with claim 40, wherein the vessel fills a majority of a volume defined by the external frame, and the cladding fills a minority of the volume with respect to the vessel.

43. A buoyancy system in accordance with claim 40, wherein the vessel has an outer diameter that substantially equals an inner diameter of the enclosure.

44. A buoyancy system in accordance with claim 40, wherein the enclosure forms a mold configured to receive an uncured foam material therein to form the buoyant cladding.

45. A buoyancy system in accordance with claim 40, wherein the cross-sectional shape is selected from the group consisting of: square, rectangular, triangular, pentagonal, hexagonal, and octagonal.

46. A buoyancy system in accordance with claim 45, wherein the vessel has a substantially circular cross-sectional shape with respect to the longitudinal axis.

47. A buoyancy system in accordance with claim 40, wherein the external frame includes:

a pair of spaced apart end caps having an outer perimeter orthogonal to a longitudinal axis shaped with the least three linear sides;

longitudinal members, extending between the end caps;

lateral members, extending between the riser section and the outer perimeter; and a plurality of lift-eyes, attached to the frame, configured to allow for engaging and lifting the buoyancy joint.

48. A buoyancy system in accordance with claim 40, wherein the external frame includes:

means for intercoupling the external frame with other external frames of other buoyancy joints bundled together.

49. A buoyancy system in accordance with claim 40, wherein the plurality of buoyancy joints are oriented horizontally in the transportation configuration.

50. A buoyancy system in accordance with claim 40, wherein each of the plurality of buoyancy joints has a vessel with a diameter or length that is different from respective diameters or lengths of vessels of other buoyancy joints.

51. A buoyancy system in accordance with claim 40, further comprising a pressurization tube extending into the vessel for pressuring the vessel.

52. A buoyancy system in accordance with claim 40, wherein the plurality of buoyancy joints are distributed in series with a plurality of risers to form a length at least as long as 10,000 feet; and the individual buoyancy joints are sized to produce at least 50 kips net buoyancy.

53. A buoyancy system in accordance with claim 40, further comprising means for mitigating drag or vortex-induced vibration.

* * * * *